US008818258B2

(12) United States Patent
Burns

(10) Patent No.: US 8,818,258 B2
(45) Date of Patent: Aug. 26, 2014

(54) GEOGRAPHICALLY-BASED INFORMATION DISTRIBUTION SYSTEM

(75) Inventor: Chester Allen Burns, Reno, NV (US)

(73) Assignee: Cirrus Systems, LLC, Sparks, NV (US)

( * ) Notice: Subject to any disclaimer, the term of this patent is extended or adjusted under 35 U.S.C. 154(b) by 893 days.

(21) Appl. No.: 12/251,369

(22) Filed: Oct. 14, 2008

(65) Prior Publication Data

US 2010/0093272 A1 Apr. 15, 2010

(51) Int. Cl.

| | |
|---|---|
| ***H04H 40/00*** | (2008.01) |
| ***G08G 1/0962*** | (2006.01) |
| ***G08G 1/137*** | (2006.01) |

(52) U.S. Cl.

CPC ..... *G08G 1/0962* (2013.01); *G08G 1/137* (2013.01)

USPC ..... 455/3.06

(58) Field of Classification Search

USPC ..... 455/3.06

See application file for complete search history.

(56) References Cited

U.S. PATENT DOCUMENTS

| | | | | |
|---|---|---|---|---|
| 6,246,932 | B1 | 6/2001 | Kageyama et al. | |
| 2002/0032035 | A1 * | 3/2002 | Teshima | 455/456 |
| 2002/0164962 | A1 | 11/2002 | Mankins et al. | |
| 2004/0008637 | A1 | 1/2004 | Seligsohn et al. | |
| 2005/0043885 | A1 | 2/2005 | Amlinger | |
| 2008/0291052 | A1 | 11/2008 | Burns | |
| 2010/0036717 | A1 * | 2/2010 | Trest | 705/14.1 |

FOREIGN PATENT DOCUMENTS

| | | |
|---|---|---|
| WO | WO 2007/023899 A1 | 3/2007 |
| WO | WO 2008/147872 | 4/2008 |

OTHER PUBLICATIONS

PCT Search Report for application PCT/US2009/044279 mailed Jun. 25, 2009.

* cited by examiner

*Primary Examiner* — Ankur Jain

(74) *Attorney, Agent, or Firm* — Alston & Bird LLP

(57) ABSTRACT

The present inventions pertain to the geographically based information distribution systems, including in particular systems configured to display advertisements and information about current status of public transit vehicles based on geographic position of the vehicle and/or the displays.

20 Claims, 7 Drawing Sheets

GEOGRAPHICALLY-BASED INFORMATION DISTRIBUTION SYSTEM

FIELD OF THE INVENTION

The present inventions pertain to the filed of geographically based information distribution systems, including in particular systems configured to display advertisements and information about current status of public transit vehicles based on geographic position of the vehicle and/or the display.

BACKGROUND OF THE INVENTION

Traditionally, advertisements and route information are displayed in public transit vehicles. These advertisements are usually printed advertisements. Route information usually includes a map of the route and sometimes a vehicles' schedule. Similar information and advertisements are usually provided on bus stops, commuter train stations, ferry piers, etc. Sometimes these information displays provide an estimated time of arrival (ETA) for an approaching vehicle. Usually, these advertisement displaying systems are decentralized and are not integrated with a vehicle position monitoring system.

There is a need for more sophisticated method of displaying advertisements and providing more information about the transit vehicles to the passengers on the vehicle and people waiting for the vehicles at stations.

SUMMARY OF THE INVENTION

The present invention is a system distributing information to displays based on geographic location of the displays. In preferred embodiment the system includes mobile units equipped with positioning devices, and the system distributes information based on the position information of the mobile units.

Preferably, the present invention provides a system and method for displaying dynamic information to people on public transit vehicles, to people awaiting public transit vehicles on stations, including train stations, bus stops, ferry piers and similar locations, and to general public observing these vehicles as they are passing by.

In a preferred embodiment, the system includes displays located at public transit stops and a database storing location information of the displays. Preferably, the system is configured to communicate with the displays, and the displays are configured to display segments of video. In one of the embodiments, the video segment to be exhibited on a particular display is chosen by the system based on location of the display. In a preferred embodiment, the video segments are advertisements or public transit announcements. Preferably, the system comprises vehicle position devices, located on public transit vehicles, and the system is configured to obtain current vehicle position information from these devices and to transmit to the displays information about location and progress of the vehicles. Preferably, in some embodiments, the video segment is an audio-video segment and the displays are audio-video displays.

Preferably, the system includes displays located on public transit vehicles. In a preferred embodiment, the vehicles are equipped with vehicle position receivers, that dynamically receive position information of the vehicle, and vehicle position transmitters, that transmit this information to a processing unit. Based on a current position of the vehicle, the processor unit determines what advertisements should be exhibited on the displays, and transmits corresponding instructions to the displays. In a preferred embodiment, the system also transmits to the displays instructions to exhibit the vehicle's position. In one of the embodiments, a vehicle can be equipped with multiple displays, exhibiting the same or different advertisements/vehicle position information. These displays can be positioned inside the vehicle to be observed by the passengers or on the outside of the vehicle to be observed by general public.

Another embodiment of the system includes a combination of displays located inside the vehicles, displays located outside the vehicles and/or on the vehicle stops.

In another embodiment, the system includes video display, a mobile unit position receiver, a processing unit, and a video image database all located on the mobile unit.

The geographically-based information distribution system may be used in combination with the alert and warning system, as described in U.S. patent application Ser. No. 11/807,103; entitled "Alert and warning system and method," filed May 25, 2007, and incorporated herein by reference in its entirety.

BRIEF DESCRIPTION OF THE DRAWINGS

Some embodiments of the invention are disclosed in greater detail in the accompanying drawings, in which.

For the sake of clarity, the figures show some embodiments of the invention in a simplified manner. In the figures, like reference numbers refer to like elements.

DETAILED DESCRIPTION OF SOME EMBODIMENTS OF THE INVENTION

Figure 1:
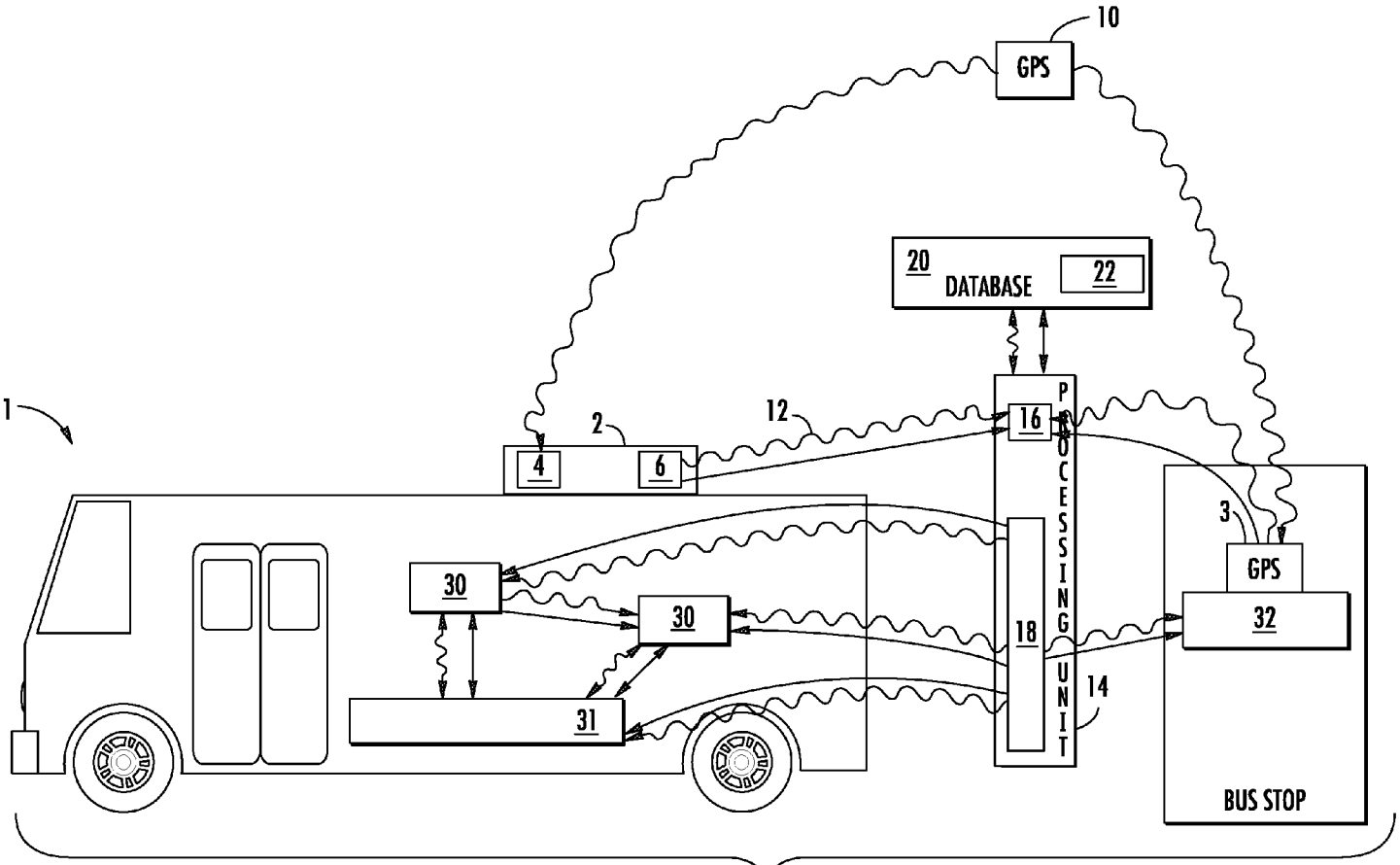
FIG. 1 is a diagram of a geographically-based information distribution system.

FIG. 1 schematically shows a geographically-based information distribution system. Preferably, vehicles 1 are equipped with vehicle position units 2. The vehicle position units 2 preferably include a vehicle position receiver 4 and a vehicle position transmitter 6. The vehicle position receiver 4 may be any known system that is capable of providing location coordinates of the vehicle 1. Preferably, the vehicle position receiver 4 is a GPS receiver that receives GPS signal 8 from a GPS satellite 10. The vehicle position transmitter 6 preferably transmits the vehicle position information, which preferably includes the vehicle's geographic location, via a vehicle position information communication 12 to a processing unit 14. The vehicle position information communication 12 can be either wireless or by wires.

In one of the embodiments of the present invention, the processing unit 14 is located on the vehicle 1. Alternatively, the processing unit 14 is stationary.

The processing unit 14 preferably includes a processing unit receiver 16 and a processing unit transmitter 18. The processing unit receiver receives the vehicle position information communications 12 from the vehicle 1. The processing unit transmitter transmits communications to video displays 30, 31 32.

In one of the embodiments, the video displays 30 and 31 are located on the vehicles 1, inside 30 and/or outside 31 the vehicle 1. In another embodiment, the system also includes stationary video displays 32 placed at predetermined locations. In a preferred embodiment, the vehicles 1 are public transit vehicles and the stationary video displays 32 are located on public transit stops. In one of the embodiments some locations are equipped with multiple stationary video displays 32.

Preferably, stationary video displays 32 are equipped with display position units 3. The display position unit 3 communicates with the GPS satellite 10 to obtain the display geographic position information and transmits this information to the processing unit 14.

Preferably, vehicle 1 is equipped with multiple video displays 30 and 31. The interior of the vehicle 1 may have a number of video displays 30, located at different locations within the vehicle. In one embodiment, these video displays present the same video segments. In another embodiment these displays 30 present different video segments. A vehicle 1 may also be equipped with multiple outside video displays 31. These displays may be located, for instance, on the left and on the right sides of the vehicle. Similarly, these outside displays may present the same or different video segments.

In one of the embodiments, the processing unit 14 communicates with the displays 30, 31 and 32 wirelessly. In another embodiment, the processing unit 14 communicates with the video displays 30 and 31 by wires (if the processing unit 14 is located on the vehicle 1) or communicates with the stationary displays 32 by wires (if the processing unit 14 is itself stationary). In one of the embodiments the video displays 30, 31 located on the same vehicle are configured to communicate with each other either wirelessly or by wires. When there are multiple stationary video displays 32 at the same location, in some embodiments, these stationary video displays 32 are configured to communicate with each other by wires or wirelessly.

Preferably, the system also includes a database 20. The database 20 can be at the same location as the processing unit 14. Alternatively the database can be at a different location. In some embodiments, the processing unit 14 communicates with the database 20 wirelessly. In other embodiments the processing unit 14 communicates with the database 20 directly or by wires.

The database 20 preferably includes a video segment storage 22 containing video segments that can be displayed on the video displays 30, 31 and 32. Preferably the database 20 also includes geographic zone information associated with some or all of the video segments.

In one of the embodiments, the geographic zones are parts of general geographic areas where the vehicle 1 is travelling. For example, if vehicle 1 is a bus, the geographic area is a city where the public transit system operates. If vehicle 1 is a commuter train, the geographic area is a region where the train runs. The geographic zones, corresponding to the video segments, are parts of the geographic area, targeted for displaying the video segments. For instance, if a video segment is an advertisement of toys, the corresponding geographic zone may include locations in close proximity to schools or playgrounds. If a video segment is an advertisement for luxury items, the advertiser may wish to target a financial district of the city.

Figure 2A:
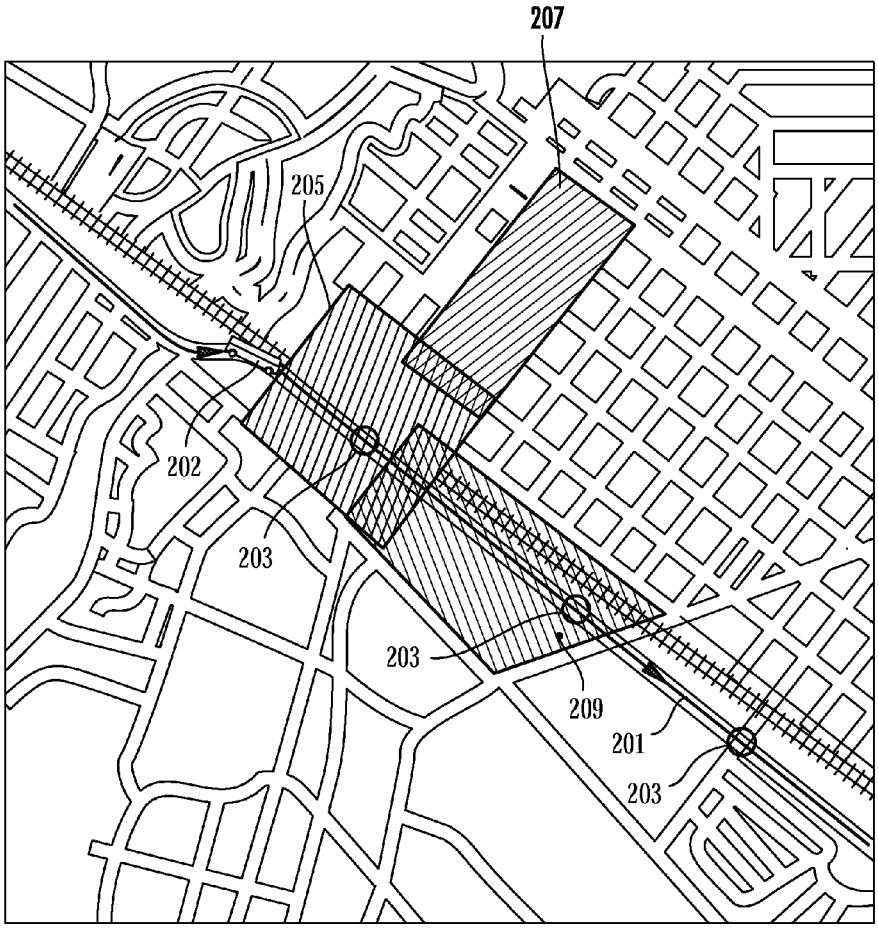
FIG. 2(*a*)-(*c*) are schematic representations of a geographic area and geographic zones.
Figure 2B:
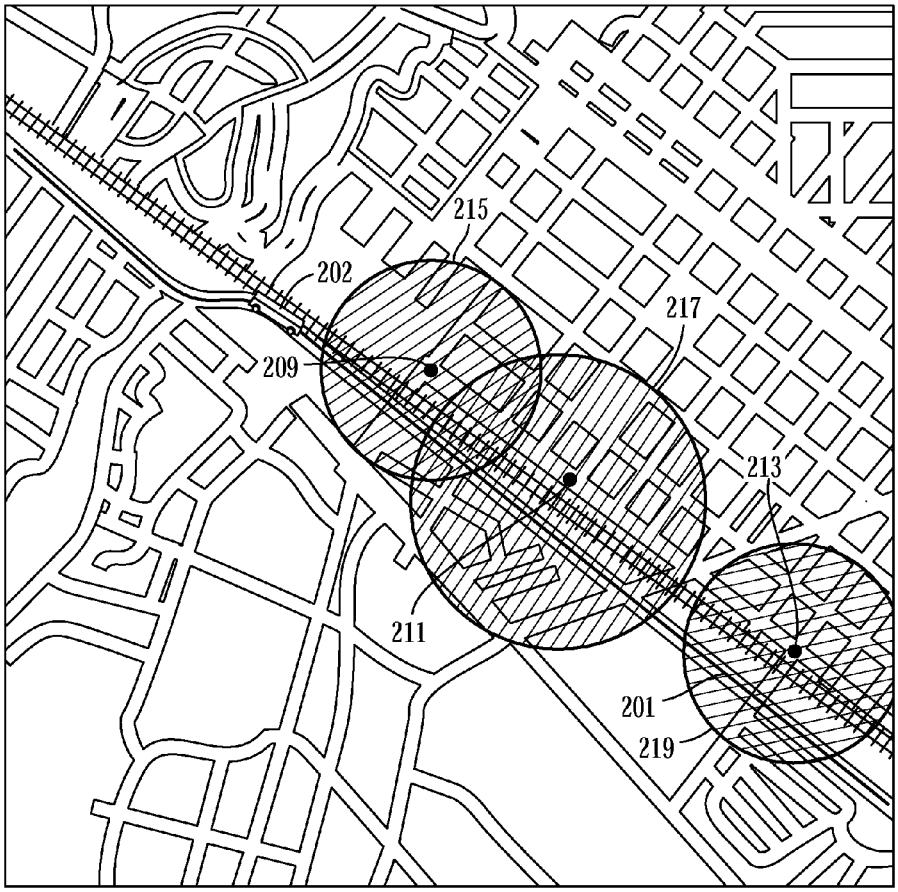
Figure 2C:
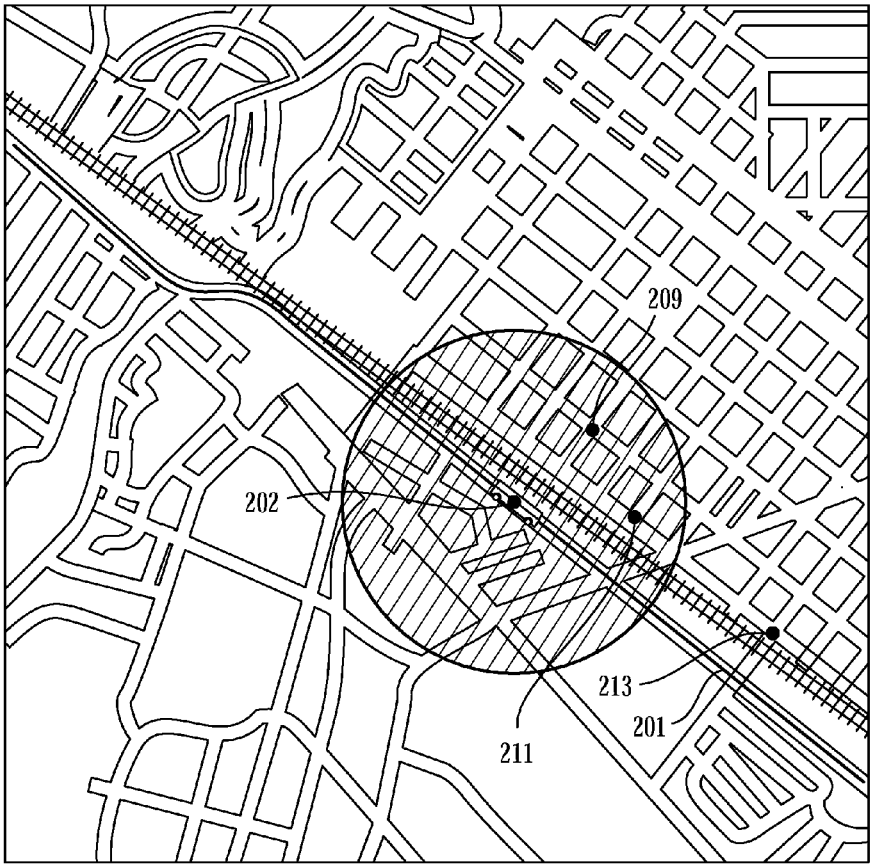

In accordance with one of the embodiments of the present invention, on FIG. 2(*a*) we show an example of geographic zones 205, 207 and 209. A vehicle 202 travels by route 201 with stops 203 and passes in and out of the zones 205 and 209.

In accordance with another embodiment of the present invention, a geographic zone can be defined by all points within a circle that has a point of interest as its center. Such points of interest may be local service providers interested in advertising to the public in close proximity to their place of business, such as local restaurants, salons, retail stores, etc. FIG. 2(*b*) shows such points of interest 209, 211 and 213 and corresponding geographic zones 215, 217 and 219, which are defined by circles with centers at the points of interest209, 211 and 213. The zones 215, 217 and 219 can have different radii.

In accordance with another embodiment of the present invention, as shown on FIG. 2(*c*), a geographic zone can be defined as all points within a circle that has a vehicle 202 as its center. FIG. 2(*c*) shows circle 221 surrounding the vehicle 202. Points of interest 209 and 211 are located within the geographic zone 221. Point of interest 213 is not in the zone 221, and the video segments associated with this point of interest are not selected.

Some of the video segments may have no predetermined geographic zones. For these video segments, the entire geographic area is their geographic zone.

Also, preferably the database includes priority information associated with the video segments that determines how often they are displayed. In another embodiment, the database includes information about time periods associated with the video segments, determining during what time the corresponding video segment should be displayed. The database 20 also may include whether a certain video segment is to be displayed on the video displays 30 located inside a vehicle 1, on the displays 31 located outside a vehicle 1, or on the stationary video displays 32.

In a preferred embodiment, for the video displays 30 and 31 located on the vehicles 1, the database 20 also includes the information about which vehicle carries what particular displays 30 and 31 and whether the display is located inside or outside the vehicle 1.

Preferably the database 20 also includes information about geographic locations of the stationary video displays 32. In another embodiment, when stationary video displays 32 are equipped with display position units 3, the processing unit 14 periodically receives from the display position units 3 information about current locations of the stationary displays 32 and updates corresponding information in the database 20.

Having the stationary displays 32 equipped with GPS display position units 3, provides additional efficiency and reliability to the system. For instance, the database 20 does not have to be manually updated when one of the stationary displays is moved. Also, the risk of data entry mistakes for the display locations is eliminated.

In a preferred embodiment, when the vehicle 1 is a public transit vehicle and is supposed to follow a pre-existing route and schedule, the route and schedule information is also stored in the database 20 and is accessible by the processing unit 14.

The processing unit 14 receives the vehicle position information communication 12 from the vehicle position unit 2. Then the processing unit 14 selects the video segments to be transmitted to the displays 30, 31 and 32.

When selecting video segments for the video displays 30 and/or 31, located on the vehicles 1, the processing unit 14 accesses the database 20 and identifies the video segments whose geographic zones include the current location of the vehicle 1.

For instance, when the vehicle 202, as shown of FIG. 2(*a*), moves down the route 201, it first enters zone 205. At this point all video segments associated with this zone 205 are selected by the processing unit 14. When the vehicle 202 crosses the boundary of zone 209, the video segments associated with either zone 205 or zone 209 or both are selected by the processing unit 14. When the vehicle 202 leaves zone 205, the video segments associated with zone 209 are selected by the processing unit 14 and the video segments associated with zone 205 but not with zone 209 are no longer selected.

Similarly, referring to FIG. 2(*b*), when vehicle 202 moves down the route 201, first the video images associated with point of interest 209 are selected, then the video images associated with point of interest 209 or point of interest 211, then only the video images associated with the point of interest 211.

Referring to FIG. 2(*c*), the vehicle 202 moves down the route 201. At the point shown on the FIG. 2(*c*), points of interest 209 and 211 are within the vehicle's geographic zone 221. The video images associated with these points of interest are selected by the processing unit 14 at this point.

In another embodiment, the processing unit 14 determines the next stop for the vehicle 1 based on the vehicle position information, obtained from the vehicle position unit 2, and schedule and route information available from the database 20. Then the processing unit 14 selects video segments associated with the geographical location of the upcoming vehicle stop (where the passengers may disembark).

From the selected video segments the processing unit 14 selects the video segments to be displayed on any specific video display 30, 31. The selection can be based on the video segment's priority, specified time periods for displaying the video segment, preexisting schedule, random selection, etc.

Preferably, when the processing unit 14 selects video segments to be displayed on the stationary video displays 32, it accesses the information about geographic locations of these displays 32. This information is stored in the database 20. The processing unit 14 makes its selection in part based on this video display location information.

In one of the embodiments the processing unit 14 selects video segments to be displayed on the stationary video displays 32 based solely on the geographic locations of these stationary video displays 32, which are stored in the database 20.

In another embodiment, the processing unit 14 select video segments to be displayed on the video displays 30, 31, and/or 32 independent of their physical location and independent from the vehicle position information received from the vehicle position units 2.

In another embodiment, in the process of determining which video segments to display at the stationary video display 32, the processing unit 14 receives the vehicle position information from the vehicle position units 2, determines which vehicle will arrive next at the geographic location of the stationary video display 32, obtains the route and schedule information for this vehicle 1 and determines the next stop for the vehicle 1 after this vehicle 1 stops at the geographic location of the stationary video display 32. Then the processing unit 14 selects video segments, associated with the next stop, to be displayed at the stationary video display 32. This way the passengers getting on the bus will be receiving information related to their destination rather than related to the place they are leaving.

In one of the embodiments of this invention, after receiving the vehicle position information communication 12 from the vehicle positioning unit 2, the processing unit 14 generates vehicle progress video segments. Preferably, these vehicle progress video segments are specific to the video displays 30, 31 and 32, where they are to be displayed, and include information about current location of the vehicles 1, ETA at the next stop, and/or other similar information.

For vehicle progress video segments to be displayed on the stationary video displays 32, preferably, the processing unit 14 identifies the vehicles 1, whose route includes the stop where the stationary video display 32 is located. The processing unit 14 identifies the vehicle 1 or group of vehicles 1 approaching this stop, based on the vehicles' 1 current locations, speed and route information stored in the database 20. Then the processing unit 14 may determine ETAs for these vehicle or vehicles. In a preferred embodiment, the processing unit 14 determines whether the vehicle 1 is moving or not. In one of the embodiments the processing unit 14 accesses current traffic information and estimates the vehicles' future progress and/or delays based on the current traffic conditions.

Based on this information, the processing unit 14 generates a vehicle progress video segment for the stationary video display 32. In the preferred embodiment this vehicle progress video segment includes information about approaching vehicles, their route identifiers, their ETAs and their current locations. Preferably, the vehicle progress video segment includes information whether the vehicle 1 is moving on not. In one of the embodiments of the invention the vehicle information is indicated as a bus icon with its route number and its ETA displayed next to or on the icon, where the wheels of the bus icon are turning when the corresponding vehicle 1 is moving.

For vehicle progress video segments to be displayed on the video displays 30, located inside the vehicles 1, preferably, the processing unit 14 accesses in the database 20 the route and schedule information for the corresponding vehicle 1 and calculates the vehicles ETA and/or determines whether the vehicle 1 is on schedule. In one of the embodiments the processing unit 14 accesses current traffic information and estimates the vehicle's future progress and/or delays based on current traffic conditions. Preferably, the processing unit 14 generates the vehicle progress video segment to be displayed on the vehicle 1, including in it the information about the vehicle's ETA at the next stop, possible delays down the route, and/or a map of the surrounding area showing the current location of the vehicle 1. The map can also show other public transit vehicles in the area, from the same or other routes, in order to assist the passengers transferring between public transit routes.

In a preferred embodiment, vehicle progress video segments to be displayed on the video displays 31, located on the outer surface of the vehicles 1, only include the vehicle route information (route number) leaving maximum amount of space for advertisement video segments. Alternatively, the vehicle progress video segment to be displayed on the video displays 31 may include any and all information from the vehicle progress video segment for the video displays 30, located inside the vehicles 1.

Preferably, the processing unit 14 is configured to generate video segments containing emergency alert information. In a preferred embodiment, the processing unit 14 is in communication with the Emergency Alert System, Homeland Security Advisory System or any other national or local alert system. Based on the information received from such alert system, the processing unit 14 can generate a video segment containing, for instance, an Amber alert kidnapping alert, an extreme weather alert, or a terror alert. Such video segment preferably includes a description of the alert event, possible duration of the alert event, and other information.

Figure 3:
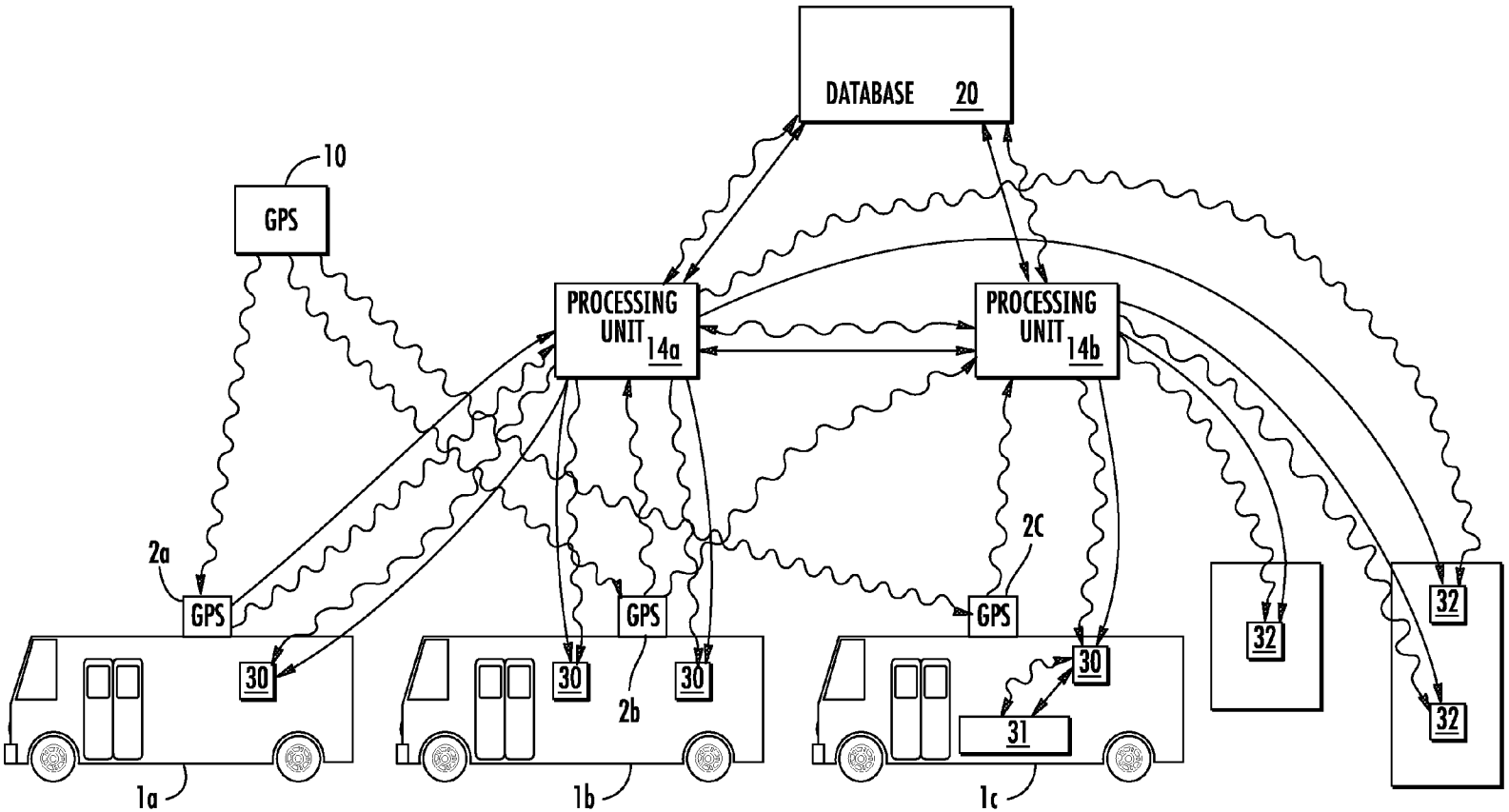
FIG. 3 is a diagram of another embodiment of the geographically-based information distribution system with a plurality of processing units.

Preferably the geographically-based information distribution system includes a plurality of processing units. FIG. 3 depicts a preferred embodiment comprising at least two processing units 14*a* and 14*b*. The vehicle position receivers 2 located on the vehicles 1*a* 1*b* and 1*c* receive the vehicle position information from the GPS satellite 10. The vehicle position unit 2*a* transmits the vehicle position information to the processing unit 14*a*. The vehicle position unit 2*b* transmits the vehicle position information to the processing units 14*a* and 14*b*. The vehicle position unit 2*c* transmits the vehicle position information to the processing unit 14*b*. As discussed above, the processing units 14*a* and 14*b* select and/or generate video segments and transmit them to video displays 30, 31 and/or 32, located inside the vehicles 1, outside the vehicles 1, or at the predetermined geographic locations. In preferred embodiment, the processing units 14*a* and 14*b* communicate with database 20. Alternatively, the system incorporates multiple databases 20*a* and 20*b* (shown on FIG. 4). Databases 20*a* and 20*b* may contain all information relating to all vehicles and displays comprising the system. Alternatively, database 20*a* may contain only information pertaining to vehicles and displays associated with the processing unit 14*a* and database 20*b* may contain only information pertaining to vehicles and displays associated with the processing unit 14*b*.

Preferably, the processing units 14*a* and 14*b* are configured to communicate with each other. This may be accomplished over a wireless communication or preferably through a direct internet connection. Preferably, if one of the processing units 14*a* is not functional, the other processing unit 14*b* can be configured to communicate with the vehicle position units and video displays associated with the processing unit 14*a*.

Figure 4:
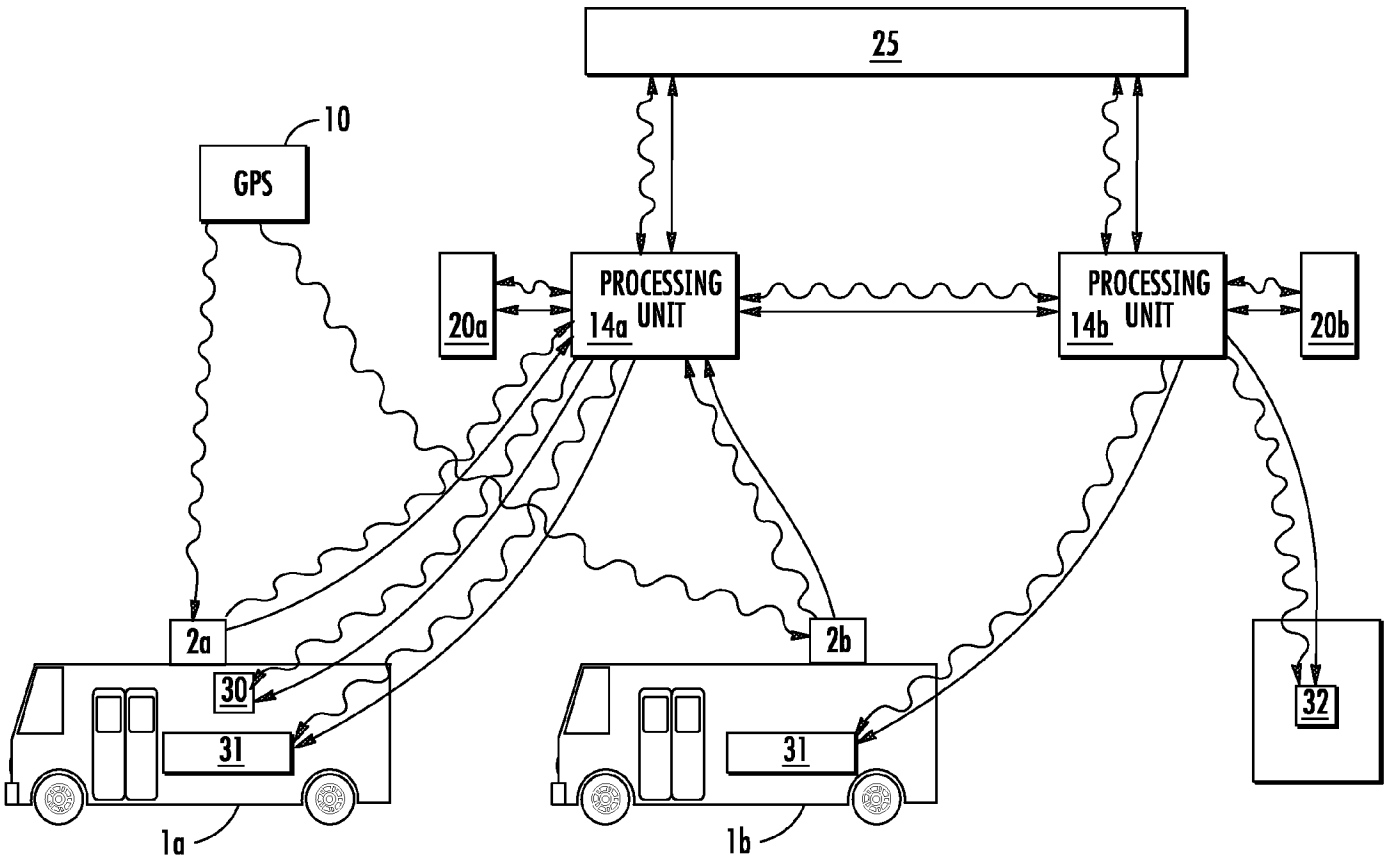
FIG. 4 is a diagram of another embodiment of the geographically-based information distribution system with a plurality of processing units and a central processing unit.

In an alternate embodiment, depicted on FIG. 4, the processing units 14*a* and 14*b* may communicate with a central processing unit 25. Central processing unit 25 may have its own processing unit network an also be configured to monitor the status of any other processing units. If one of the processing units fails, the central processing unit 25 could reassign the vehicles 1, with their vehicle position units 1, and displays 30, 31 and 32 to ensure full functioning of the system and to avoid overload of any one processing unit.

Figure 5:
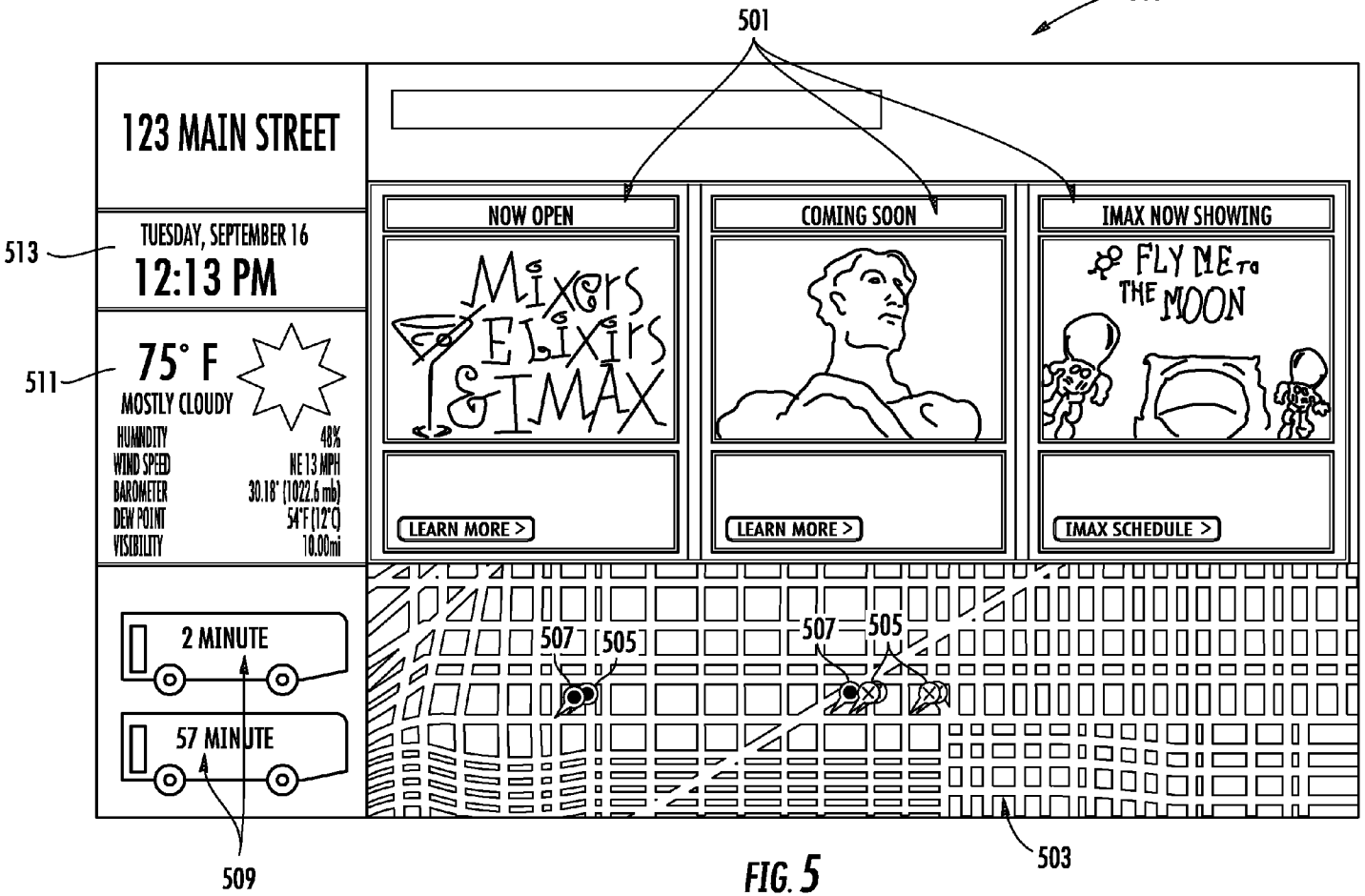
FIG. 5 is a sample view of a video display.

FIG. 5 depicts a sample configuration of an image exhibited on a stationary video display 32 which is a part of the geographically-based information distribution system. Preferably, the image 500 includes a number of advertisements 501. In preferred embodiment, the image 500 also includes a map 503 of the geographical area, surrounding the location of the display 32. The map 503 preferably also depicts the public transit vehicle identifiers 505, representing the vehicles 1 monitored by the geographically-based information distribution system and currently located in close proximity to the display 32. These vehicle identifiers 505 change their position on the map 503 when the corresponding vehicle 1 moves. Preferably, the vehicle identifiers 505 also change their icon when the corresponding vehicle 1 is stationary or when it reaches its scheduled stop. In a preferred embodiment, the map 503 also depicts the vehicle stops' identifiers 507.

The video image 500 also preferably includes bus icons 509 representing the vehicles 1 approaching the location of the display 32. In a preferred embodiment, the icons also include the ETA of these vehicles. The wheels of the bus icons rotate when the corresponding vehicle 1 is moving. In a preferred embodiment the bus icons also include route information (e.g. route number). The video image 500 also includes current weather information block 511, a clock 513.

I claim:

1. A geographically-based information distribution system comprising:

a first mobile unit position receiver attached to a first mobile unit, wherein the first mobile unit position receiver wirelessly receives first mobile unit position information representing the first mobile unit position;

a first mobile unit position transmitter attached to the first mobile unit, wherein the first mobile unit position transmitter transmits the first mobile unit position information;

a second mobile unit position receiver attached to a second mobile unit, wherein the second mobile unit position receiver wirelessly receives second mobile unit position information representing the second mobile unit position;

a second mobile unit position transmitter attached to the second mobile unit, wherein the second mobile unit position transmitter transmits the second mobile unit position information;

a processing unit comprising a processing unit receiver and a processing unit transmitter, wherein the processing unit includes as inputs the first mobile unit position information that is received from the first mobile unit position transmitter and the second mobile unit position information that is received from the second mobile unit position transmitter, and wherein the processing unit is configured to:

periodically identify first segments in a database, the first segments being associated with a first geographical zone that includes the first mobile unit position;

select, after a predetermined period of time, first selected segments of the first segments, wherein the first selected segments are selected by the processing unit based at least in part upon priority information associated with each of the first segments that determines how often the first segments are displayed;

transmit the first selected segments to the first mobile unit using the processing unit transmitter;

periodically identify second segments in the database, the second segments being associated with a second geographical zone that includes the second mobile unit position;

select, after a predetermined period of time, second selected segments of the second segments, wherein the second selected segments are selected by the processor based at least in part upon priority information associated with each of the second segments that determines how often the second segments are displayed;

transmit the second selected segments to the second mobile unit using the processing unit transmitter; and at least one display configured to display the first selected segments transmitted by the processing unit transmitter.

2. The geographically-based information distribution system of claim 1 wherein the first mobile unit is a vehicle.

3. The geographically-based information distribution system of claim 2, wherein the display is located inside the vehicle.

4. The geographically-based information distribution system of claim 2, wherein the display is located on an outside surface of the vehicle.

5. The geographically-based information distribution system of claim 2, wherein:

the database further includes vehicle route information and schedule; and the processing unit is configured to compare the vehicle position information with the vehicle route information and to schedule and to transmit results of the comparison to the vehicle.

6. The geographically-based information distribution system of claim 2 wherein the display is located at a vehicle stop.

7. The geographically-based information distribution system of claim 6, wherein:

the database further includes geographical location information for the display located at the vehicle stop, and the processing unit is further configured to select the first selected segments to be displayed on the display based on the geographic location of the display.

8. The geographically-based information distribution system of claim 2, wherein the processing unit is configured to determine whether the vehicle is moving and to transmit information based on the determination to the vehicle.

9. The geographically-based information distribution system of claim 1 wherein at least one of the first segments is an audio-video segment and the display is an audio-video display.

10. The geographically-based information distribution system of claim 1 wherein the first mobile unit position receiver is a satellite navigation system receiver configured to receive the first mobile unit position information from a satellite navigation system network.

11. The geographically-based information distribution system of claim 10 wherein the satellite navigation system receiver is a GPS receiver and the satellite navigation system network is a GPS network.

12. The geographically-based information distribution system of claim 1 wherein at least one of the first segments is static.

13. The geographically-based information distribution system of claim 1, wherein at least one of the first segments is dynamic.

14. The geographically-based information distribution system of claim 1, wherein the processing unit transmitter is configured to transmit the first selected segments wirelessly.

15. The geographically-based information distribution system of claim 1, wherein:

the database further includes at least one time period associated with each of the first segments, and the processing unit is further configured to select the first selected segments from the first segments at least in part based on a time period of the first selected segments and the current time.

16. The geographically-based information distribution system of claim 1, the system further comprising at least three mobile units.

17. The geographically-based information distribution system of claim 1, wherein the first mobile unit position receiver and the first mobile unit position transmitter are included in a single apparatus.

18. The geographically-based information distribution system of claim 1, wherein the first geographical zone and the second geographical zone are different.

19. The geographically-based information distribution system of claim 1, wherein the first segments and the second segments are different.

20. A geographically-based information distribution system comprising:

mobile units, wherein each of mobile units is attached to a mobile unit position receiver that wirelessly receives mobile unit position information, and wherein each of the mobile units is attached to a mobile unit position transmitter that transmits the mobile unit position information;

a processing unit comprising:

a processing unit receiver; and a processing unit transmitter, wherein the processing unit has as inputs the mobile unit position information that is received from the mobile unit position transmitters;

displays, wherein at least one of the displays is a stationary display; a database including:

geographical location information of the stationary display;

segments, wherein at least some of the segments include content associated with the geographical location information of the stationary display;

priority information associated with each of the segments that determines how often the segments are displayed;

and wherein the processing unit is configured to:

select, from the database after a predetermined period of time, selected segments to be displayed on the stationary display based on the geographic location of the stationary display and based at least in part upon the priority information associated with each of the segments that determines how often the segments are displayed; and generate at least one presentation;

wherein the processing unit transmitter transmits to the stationary display the segments and the presentation.

* * * * *